US005090336A

United States Patent [19]

Longaker, Sr. et al.

[11] Patent Number: 5,090,336

[45] Date of Patent: Feb. 25, 1992

[54] PLASTIC SHIPPING PLATFORM BLANK AND SHIPPING PLATFORM

[75] Inventors: William A. Longaker, Sr., Golden; John A. Hansen, Denver, both of Colo.

[73] Assignee: Golden Technologies Company, Inc., Golden, Colo.

[21] Appl. No.: 597,577

[22] Filed: Oct. 15, 1990

[51] Int. Cl.[5] ..... B65D 19/00

[52] U.S. Cl. ..... 108/51.1; 108/51.3; 108/57.1

[58] Field of Search ..... 108/57.1, 51.1, 51.3, 108/56.1, 901

[56] References Cited

U.S. PATENT DOCUMENTS 2,446,914 8/1948 Fallert et al. ..... 108/57.1 X
2,479,728 8/1949 Darling ..... 108/51.3
3,216,376 11/1965 Anderson et al. ..... 108/51.3
3,302,593 2/1967 Roberts ..... 108/51.3
3,464,371 9/1969 Gifford ..... 108/51.1 X
3,659,534 5/1972 Childs ..... 108/57.1 X
3,680,496 8/1972 Westlake, Jr. ..... 108/51.1
3,952,672 4/1976 Gordon et al. ..... 108/57.1 X
4,714,026 12/1987 Yamaguchi et al. ..... 108/51.3 X

*Primary Examiner*—Peter A. Aschenbrenner
*Attorney, Agent, or Firm*—Klaas & Law

[57] ABSTRACT

A plastic shipping platform formed from a unitary sheet of plastic material having a length, a width and a thickness and provided with a plurality of spaced apart widthwise extending fold lines, integral support support columns and cut-out portions so that the unitary sheet may be folded around the fold lines and superposed portions may be secured together to form a plastic shipping platform having a length, a width and a height.

10 Claims, 3 Drawing Sheets

PLASTIC SHIPPING PLATFORM BLANK AND SHIPPING PLATFORM

FIELD OF THE INVENTION

The invention relates generally to shipping platforms which are used to support articles for storage, transporting and distribution and more particularly to a plastic shipping platform for such use formed from a unitary sheet of a plastic material.

BACKGROUND OF THE INVENTION

There are many different types of shipping platforms for supporting articles for storage, shipping and distribution on the market. One of the older shipping platforms is the conventional wooden shipping platform. Lately, a variety of plastic shipping platforms have been provided such as those illustrated in U.S. Pat. Nos. 4,799,433 and 4,843,976 wherein an upper deck is spaced from a lower deck by a plurality of vertical columns. These types of shipping platforms required separate molding operations and must be assembled. Other plastic shipping platforms are illustrated in U.S. Pat. Nos. 3,707,127; 4,339,040; 4,375,265; 4,397,246; 4,403,555; 4,428,306; 4,597,338; 4,606,278; 4,735,153; 4,848,247 and 4,879,956. These patents disclose a wide variety of plastic shipping platforms that have been proposed but not widely accepted. Therefore, there exists a need for a plastic shipping platform that is light in weight, capable of supporting heavy loads and is easy to manufacture and assemble.

BRIEF DESCRIPTION OF THE INVENTION

This invention provides a plastic shipping platform for supporting articles for shipping storage and distribution that is formed from a unitary sheet of a plastic material folded in such a manner that maximum strength of material is achieved with a minimum amount of material.

In a preferred embodiment of the invention, a unitary sheet of plastic material is severed from a continuous extrusion of the plastic material and passed through a plurality of hot or cold plastic forming operations to produce a blank for forming a plastic shipping platform. The material is a thermoplastic material having relatively rigid properties when at temperatures lower than 150 degrees F, such as polyethylene terephallate or other materials having similar characteristics. The blank is a unitary sheet of plastic material having a length, a width and a thickness with parallel lengthwise extending opposite edge portions and parallel widthwise extending opposite edge portions. A plurality of spaced apart, parallel, widthwise extending fold lines are formed in the unitary sheet and divide the unitary sheet into top and bottom support panels, top and bottom surface forming panels and a plurality of spaced apart integral sidewall forming panels. Each of the sidewall forming panels has a pair of spaced apart cut-out portions for receiving the tines of a fork lift. Each of the top and bottom support panels has a plurality of integral, spaced apart projecting support means formed thereon and which support means are located to be in contacting relationship when the top support panel is superposed over the bottom support panel. The bottom support panel and the bottom surface forming panel have a plurality of spaced apart openings formed therein, which openings are in alignment when the bottom support panel is in superposed relationship with the bottom surface forming panel so that portions of a shipping platform moving vehicle, such as a walkie, may pass therethrough.

The blank is folded around the fold lines to produce a plastic shipping platform having a first sidewall extending in a widthwise direction and lying generally in a vertical plane. A bottom support panel is integral with the first sidewall and extends in a generally horizontal plane. A second sidewall is integral with the bottom support panel and is located opposite and parallel to the first sidewall. A top support panel is integral with the second sidewall and is located opposite and parallel to the bottom support panel. A third sidewall is integral with the top support panel and is in juxtaposed relaticnship with the first sidewall. A bottom surface forming panel is integral with the third sidewall and is in superposed relationship with the bottom support panel. First securing means are provided for securing together at least portions of the bottom support panel and the bottom surface forming panel. A fourth sidewall is integral with the bottom surface forming panel and is in juxtaposed relationship with the second sidewall. A top surface forming panel is integral with the fourth sidewall and is in superposed relationship with the top support panel. Second securing means are provided for securing together at least portions of the top surface forming panel and the top support panel. A fifth sidewall is integral with the top surface forming panel and is in juxtaposed relationship with the third sidewall. Third securing means are provided for securing together at least portions of the first, third and fifth sidewalls. If desired, fourth securing means are provided for securing together at least portions of the second and fourth sidewalls. The first, third and fifth sidewalls and the second and fourth sidewalls have aligned openings so that the tines of a fork lift may be passed therethrough. The top support panel has a plurality of spaced apart support means projecting downwardly therefrom and which are located so that the bottom surfaces thereof are in contact with the top surfaces of a plurality of spaced apart support means projecting upwardly from the bottom support panel to provide support for the articles placed on the plastic shipping platform. As stated above, the bottom support panel and the bottom surface forming panel each has a plurality of spaced apart openings formed therein which are in alignment when these panels are in the superposed relationship so that portions of a shipping platform moving vehicle may pass therethrough. In another embodiment of the invention, additional sidewall forming panels are provided and have fold lines which extend in a lengthwise direction so that the additional sidewall panels may be folded to provide opposite lengthwise extending sidewalls.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
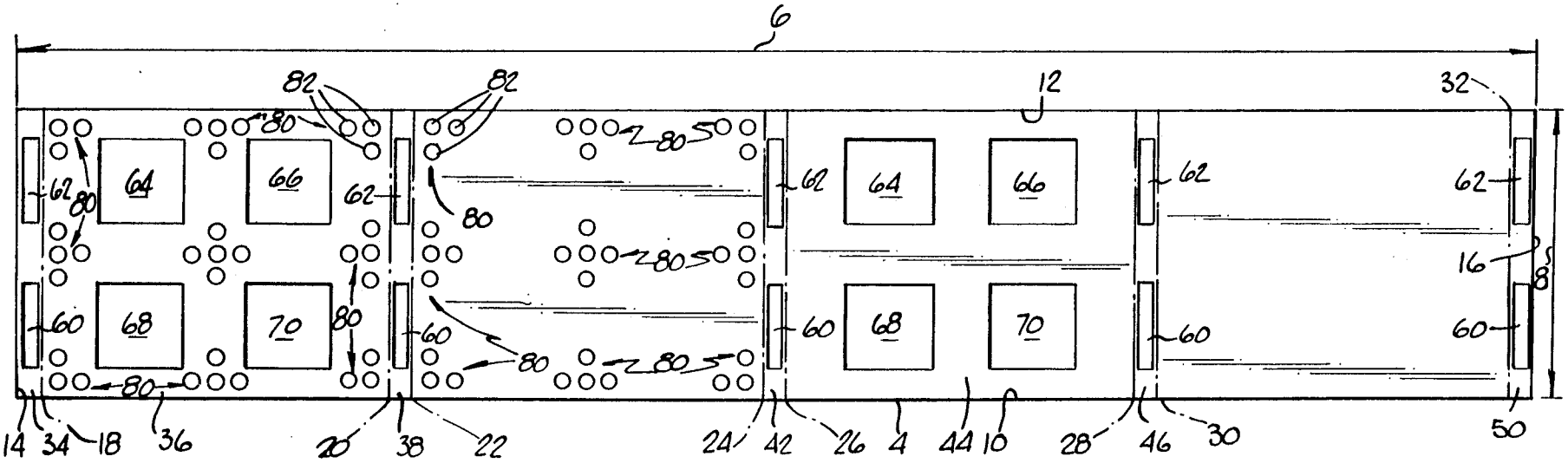
FIG. 1 is a top plan view of one preferred blank for forming a plastic shipping platform of this invention.
Figure 3:
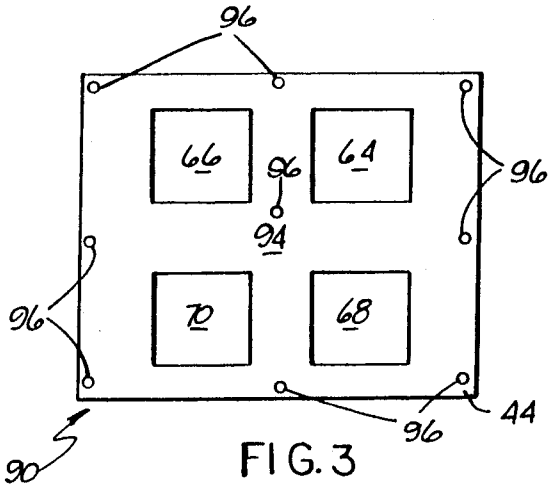
FIG. 3 is a bottom plan view of FIG. 2.
Figure 2:
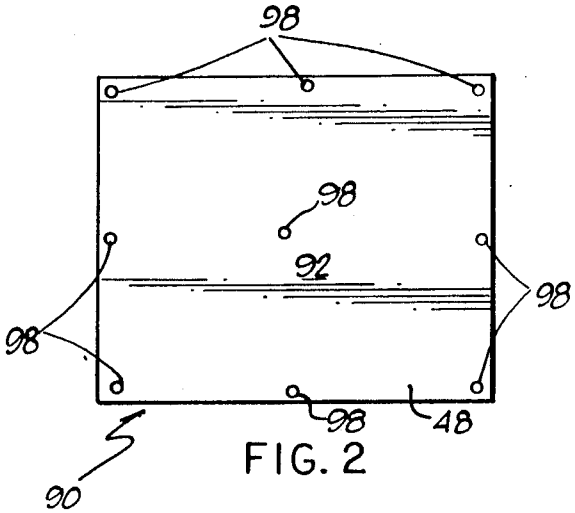
FIG. 2 is a top plan view of a plastic shipping platform of this invention.

In FIG. 1, there is illustrated a blank 2 of a plastic material which blank is a unitary sheet of plastic material which is severed from a continuous extrusion of the plastic material and passed through a plurality of hot or cold plastic forming operations to produce the blank 2. The material is a thermoplastic material having relatively rigid properties when at temperatures lower than 150 degrees F, such as polyethylene terephallate, or other materials having similar characteristics. The blank 2 has a length 4, a width 6 and a thickness 8, FIG. 4, and has parallel, lengthwise extending opposite edge portions 10 and 12 and parallel, widthwise extending opposite edge portions 14 and 16. The blank 2 has a plurality of spaced apart, widthwise extending, parallel fold lines 18, 20, 22, 24, 26, 28, 30 and 32 which divide the blank 2 into a first sidewall forming panel 34, a bottom support panel 36, a second sidewall forming panel 38, a top support panel 40, a third sidewall forming panel 42, a bottom surface forming panel 44, a fourth sidewall forming panel 46, a top surface forming panel 48 and a fifth sidewall forming panel 50.

The first sidewall forming panel 34 has lengthwise extent that is slightly less than the lengthwise extent of the second sidewall forming panel 38 which has a lengthwise extent that is slightly less than the lengthwise extent of the third sidewall forming panel 42 which has a lengthwise extent that is slightly less than the lengthwise extent of the fourth sidewall forming panel 46 which has a lengthwise extent that is substantially the same as the lengthwise extent of the fifth sidewall forming panel 50. Also, the bottom support panel 36 has a lengthwise extent that is slightly less than the lengthwise extent of the top support panel 40 which has a lengthwise extent that is slightly less than the lengthwise extent of the bottom surface forming panel 44 which has a lengthwise extent that is slightly less than the lengthwise extent of the top surface forming panel 48.

Each of the sidewall forming panels 34, 38, 42, 46 and 50 have a pair of spaced apart cut-out portions 60 and 62 which, as explained below, provide openings for the tines of a fork lift (not shown). The bottom support panel 36 and the bottom surface forming panel 44 have four cut-out portions 64, 66, 68 and 70 which, as explained below, provide openings for portions of a vehicle (not shown) used to move shipping platforms in warehouses.

Each of the bottom and top support panels 36 and 40 have a plurality of support means 80 at spaced apart locations, illustrated in FIG. 1 as being nine locations but can be more or less locations. The support means 80 comprise a plurality of hollow support columns 82 which project upwardly from the top and bottom support panels 36 and 40. Each hollow support column 82 has a generally conical outer surface 84, FIG. 4, and a closed end surface 86. The support columns 82 are located so as to provide two spaced apart openings 88 to receive the tines of a fork lift. Each hollow support column 82 is integral with the top or bottom support panels 36 o 40 and is formed by displacing a portion of the extruded sheet.

A plastic shipping platform 90 formed from the blank 2 is illustrated in FIGS. 2-5. The top surface forming panel 48 has a continuous smooth surface 92 and the bottom surface forming panel 44 has a continuous smooth surface 94 except for the cut-out portions 64, 66, 68 and 70.

Figure 4:
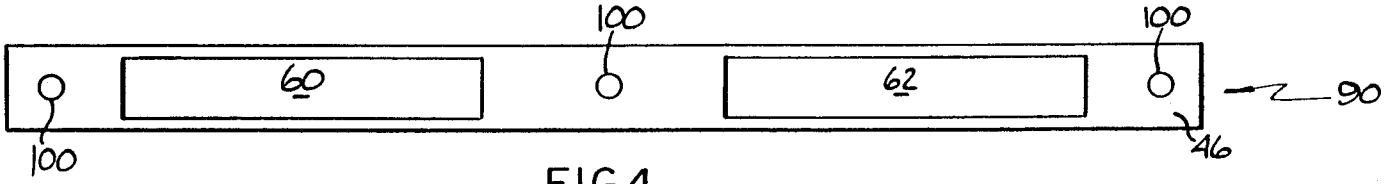
FIG. 4 is a side elevational view taken from the right side of FIG. 2.
Figure 5:
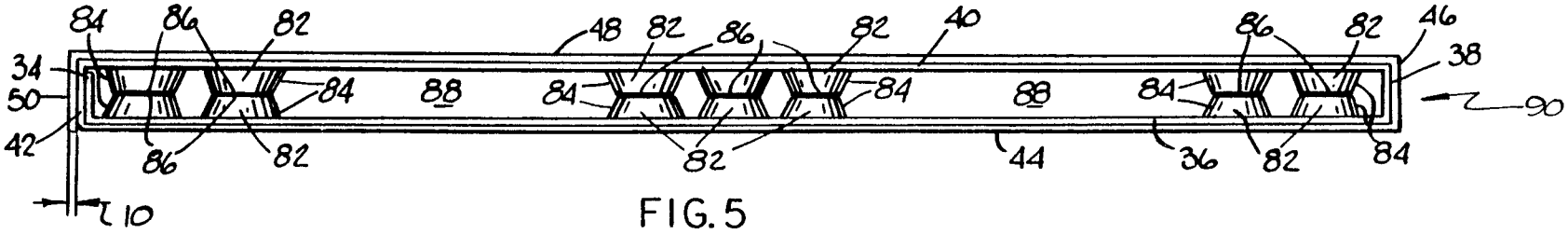
FIG. 5 is a side elevational view taken from the lower side of FIG. 2.

The folding sequence is illustrated in FIG. 4. The first sidewall forming panel 34 is folded around fold line 18 so that it extends generally in a vertical plane. The second sidewall forming panel is folded around fold line 20 and then around fold line 22 so that the second sidewall forming member 38 is located opposite and parallel to the first sidewall forming panel 34 and the top support panel 40 is superposed over the bottom support panel 36 with the end surfaces 86 of the support columns 82 in contacting relationship. The third sidewall forming panel 42 is then folded around fold line 24, then around fold line 26 so that the third sidewall forming panel 42 is in a juxtaposed relationship with the first sidewall forming panel 34 and the bottom surface forming panel 44 is in a superposed relationship with the bottom support panel 36 and the cut-out portions 64, 66, 68 and 70 are in alignment. The fourth sidewall forming panel 46 is folded around fold line 28 and then around fold line 30 so that the fourth sidewall forming panel 46 is in a juxtaposed relationship with the second sidewall forming panel 38 and the top surface forming panel 48 is in a superposed relationship with the top support panel 40. The fifth sidewall forming panel 50 is folded around fold line 32 so that it is in a juxtaposed relationship with the third sidewall forming panel 42. Conventional ultrasonic welding apparatus (not shown) is used to secure the bottom support panel 36 to the bottom surface forming panel 44 at a plurality of spaced apart locations 96; the top support panel 40 to the top surface forming panel 4 at a plurality of spaced apart locations 98; the fourth sidewall forming panel 46 to the second sidewall forming panel 38 at spaced apart locations 100 and the first, third and fifth sidewall forming panels 34, 42 and 50 together at spaced apart locations (not shown) similar to the spaced apart locations 100.

While the plastic shipping platform 90 can be of a variety of dimensions, in a preferred embodiment of the invention the top surface forming panel 48 has a length of about 48 inches and a width of about 40 inches and the height of the plastic shipping platform 90 is about 3 inches. The blank 2 has a thickness of about 0.040 inch and is extruded using a polyethylene terephallate. The length of the first sidewall forming panel 34 is about 2.88 inches; the length of the second sidewall forming panel 38 is about 2.92 inches; the length of the third sidewall forming panel 42 is about 2.96 inches and the lengths of the fourth and fifth sidewall forming panel 46 and 50 are each about 3.0 inches. The length of the bottom support panel 36 is about 47.88 inches; the length of the top support panel 40 is about 47.92 inches and the length of the bottom surface forming member 44 is about 47.96 inches. The cut-out portions 60 and 62 each have a length of about 12 inches and a height of about 2.84 inches and their adjacent end portions are spaced apart a distance of about 8 inches. The openings 88 formed by the support columns 82 each have a length of about 12 inches and a height of about 2.84 inches and their adjacent end portions are spaced apart a distance of about 8 inches. Each of the support columns 82 has a height of about 1.42 inches.

Figure 6:
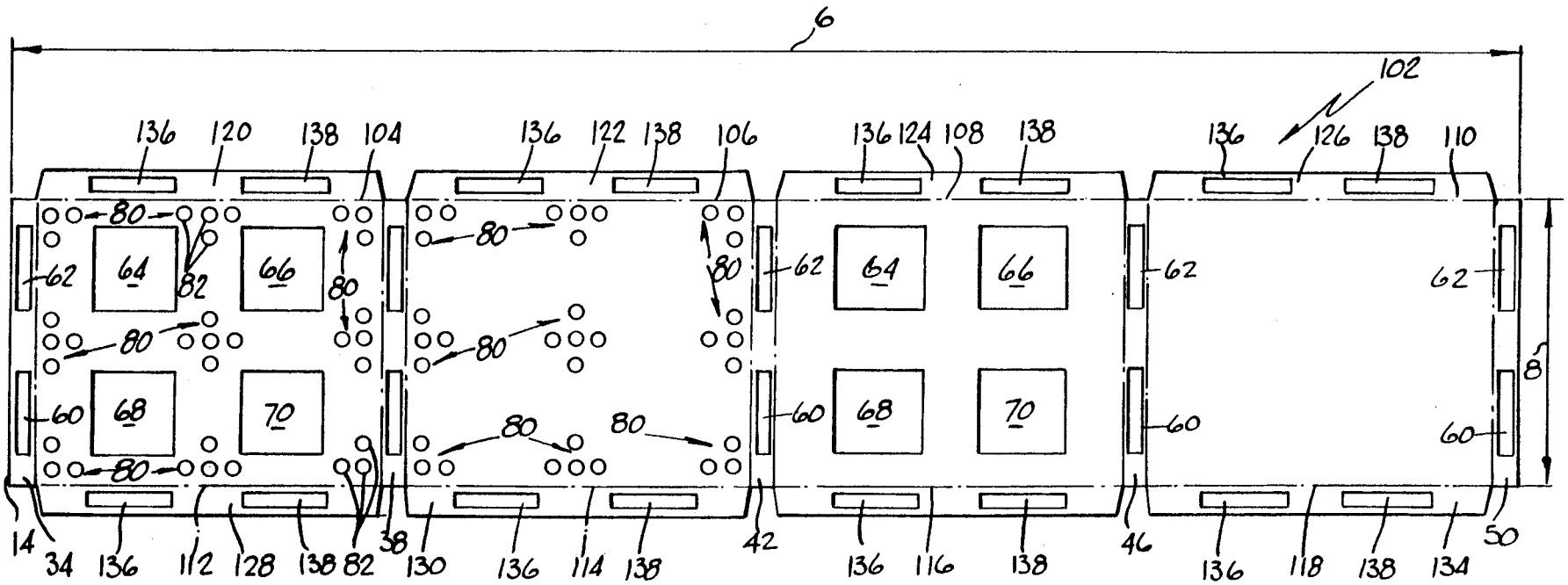
FIG. 6 is a top plan view of another preferred blank for forming a shipping platform of this invention.

In FIG. 6, there is illustrated another preferred blank 102 for forming a shipping platform of this invention.

The blank 102 has a central portion which is the same as the blank 2 in FIG. 1. The blank 102 has a plurality of additional lengthwise extending fold lines 104, 106, 108, 110, 112, 114, 116 and 118 to form additional lengthwise extending sidewall forming panels 120, 122, 124, 126, 128, 130 and 132 each of which has a pair of cut-out portions 136 and 138. As in the embodiment of FIG. 1, the sidewall forming panels 120 and 128 have widthwise dimensions that ar less than the widthwise dimensions of the sidewall forming panels 122 and 130, which have widthwise dimensions that are less than the widthwise dimensions of the sidewall forming panels 124 and 132 and which have widthwise dimensions that are less than the widthwise dimensions of the sidewall forming panels 126 and 134. The blank 102 is folded to form a shipping platform in the same manner as the folding of the blank 2 except that at the proper intervals the additional lengthwise extending sidewall forming panels 120–134 are folded around fold lines 104–118 to form opposite lengthwise extending sidewalls which are secured together by the ultra-sonic welding apparatus as described above.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A plastic shipping platform on which articles are supported comprising:

said plastic shipping platform having a length, a width and a height;

a first sidewall extending in a widthwise direction and lying generally in a vertical plane;

a bottom support panel integral with said first sidewall and extending in a generally horizontal plane;

a second sidewall integral with said bottom support panel and located opposite and parallel to said first sidewall;

a top support panel integral with said second sidewall and located opposite and parallel to said bottom support panel;

a third sidewall integral with said top support panel and in juxtaposed relationship with said first sidewall;

a bottom surface panel integral with said third sidewall and in superposed relationship with said bottom support panel;

first securing means for securing together at least portions of said bottom support panel and said bottom surface panel;

a fourth sidewall integral with said bottom surface panel and in juxtaposed relationship with said second sidewall;

a top surface panel integral with said fourth sidewall and in superposed relationship with said top support panel; and second securing means for securing together at least portions of said top surface panel and said top support panel.

2. The invention as in claim 1 and further comprising:

a fifth sidewall integral with said top surface panel and in juxtaposed relationship with said third sidewall; and third securing means for securing together at least portions of said first, third and fifth sidewalls.

3. The invention as in claim 1 wherein:

said first sidewall having a height that is less than the height of said third sidewall; and said second sidewall having a height that is less than the height of said fourth sidewall.

4. The invention as in claim 3 wherein:

each of said first, second, third and fourth sidewalls having at least a pair of spaced apart openings formed therein; and said openings in said first and third sidewalls being in alignment and said openings in said second and fourth sidewalls being in alignment so that the tines of a fork lift vehicle may pass through said openings.

5. The invention as in claim 1 wherein:

said top support panel having a first plurality of spaced apart support means projecting downwardly therefrom for providing support for said shipping platform; and said bottom support panel having a second plurality of spaced apart support means projecting upwardly therefrom for providing support for said shipping platform.

6. The invention as in claim 5 wherein:

said first and second plurality of support means being in contacting relationship.

7. The invention as in claim 6 wherein each of said first and second plurality of support means comprise:

at least one hollow column having a closed end surface.

8. The invention as in claim 6 wherein:

said first and second plurality of support means being located to provide opposite lengthwise extending sidewalls, each of which has at least a pair of spaced openings for receiving the tines of a fork lift vehicle.

9. The invention as in claim 1 wherein:

said bottom support panel having a first plurality of spaced apart openings formed therein;

said bottom surface panel having a second plurality of spaced apart openings formed therein; and said first and second plurality of openings being in alignment so that portions of a shipping platform moving vehicle may pass therethrough; and each of said first, second, third and fourth sidewalls having at least a pair of spaced apart openings formed therein;

said openings in said first and third sidewalls being in alignment and said openings in said second and fourth sidewalls being in alignment so that the forks of a fork lift vehicle may pass through said openings;

said top support panel having a first plurality of spaced apart support means projecting downwardly therefrom for providing support for said shipping platform;

said bottom support panel having a second plurality of spaced apart support means projecting upwardly therefrom for providing support for said shipping platform; and said first and second plurality of support means being in contacting relationship.

10. The invention as in claim 1 and further comprising:

at least a pair of opposite, lengthwise extending parallel sidewalls.

* * * * *